United States Patent [19]

Eaton-Williams

[11] 4,092,519

[45] May 30, 1978

[54] ELECTRODE BOILER

[76] Inventor: Raymond Herbert Eaton-Williams, "Heathers", Farnaby Drive, Sevenoaks, Kent, England

[21] Appl. No.: 653,782

[22] Filed: Jan. 30, 1976

[30] Foreign Application Priority Data

Feb. 5, 1975 United Kingdom ..... 4888/75
Feb. 5, 1975 United Kingdom ..... 4889/75

[51] Int. Cl.[2] ..... H05B 3/60; B65D 11/00

[52] U.S. Cl. ..... 219/284; 219/271; 219/289; 219/290; 219/312; 220/4 E; 220/80; 220/320

[58] Field of Search ..... 219/284–295, 219/271–276, 310, 312; 338/80–86; 174/91; 220/4 B, 4 E, 5 R, 5 A, 80, 320

[56] References Cited

U.S. PATENT DOCUMENTS

| | | | |
|---|---|---|---|
| 241,204 | 5/1881 | Fry | 220/320 |
| 1,999,962 | 4/1935 | Des Rosiers | 219/291 X |
| 2,183,049 | 12/1939 | Shofner | 220/320 X |
| 2,750,064 | 6/1956 | Clarke | 220/80 X |
| 2,880,300 | 3/1959 | Reimers et al. | 219/275 UX |
| 3,219,796 | 11/1965 | Graf et al. | 219/285 |
| 3,584,193 | 6/1971 | Badertscher | 219/285 |
| 3,775,589 | 11/1973 | Camp | 219/275 X |

*Primary Examiner*—A. Bartis
*Attorney, Agent, or Firm*—Berman, Aisenberg & Platt

[57] ABSTRACT

An electrode boiler for operation at substantially atmospheric pressure having a container consisting of upper and lower parts with a resilient band encircling the container to hold the parts together and provide a liquid seal between them. The container consists of identical moulded parts, each part having bosses which, in the upper part, are drilled to form mountings for heating electrodes, and for a level-sensing electrode if required, a tube moulded on to the closed end of each part serving, in the upper part, as a steam outlet and, in the lower part, as a connection by which water may be supplied to and drained from the container.

7 Claims, 6 Drawing Figures

ELECTRODE BOILER

This invention relates generally to steam boilers, and more particularly to an electrode boiler of the kind which is often used as a humidifier to provide steam at substantially atmospheric pressure for use in air conditioning plant although it may be used for other purposes.

In the electrode boiler the electrodes, which may consist of solid rods, plates, sheets or tubes made of metal or other electrically conductive material, or rolls or pads made of wire mesh material, are placed directly, in spaced relationship, in the water to be heated, and the heating current flows through the water between the electrodes, of which there may be two for connection to a single phase electric supply or a greater number for connection to a polyphase supply. The heating current depends upon the depth of immersion of the electrodes in the water and upon the electrical conductivity of the water. The electrical conductivity of the water varies in dependence upon the amount of mineral salts dissolved in it and the amount of tiny particles of mineral matter, such as calcium oxide or lime, carried in the water. The water may also contain many mineral elements other than lime.

The electrode boiler is normally fed from a town water supply and automatic control gear is provided to enable fresh water to enter the boiler, usually at the bottom, to replace water boiled away. It will be evident that if the boiler is initially filled with water having a particular level of contamination and the water is boiled continuously, the amount lost by evaporation being made up by feeding new town water into the boiler, the amount of contamination of the water will gradually increase, since the contamination matter is not discharged with the steam. The amount of contamination of the water will gradually increase until it reaches an unacceptable level at which lime and other substances are deposited very rapidly on the electrodes in the form of scale. In spite of steps taken to reduce the amount of scale deposits on the electrodes a stage is eventually reached at which the boiler ceases to function properly because the electrodes are completely covered with a thick deposit of lime and other scale.

A boiler of this kind may be made in the form of a container closed at its bottom and having a lid which is bolted on with the aid of a flange surrounding the open end of the container. This enables the lid to be removed so that new electrodes may be fitted and the container may be cleaned. In order to reduce the initial cost of such boilers they have been produced in the form of synthetic plastic mouldings in two dis-similar parts which were placed together and welded after the electrodes had been fitted, the intention being that since the boiler could be made comparatively cheaply it would be thrown away when it became unfit for use and a new one would be fitted to the air conditioning or other system. With the increasing cost and scarcity of raw materials, especially synthetic plastic materials, and the need to conserve materials, a requirement is emerging for a boiler which can still be manufactured quite cheaply in the first instance but which can nevertheless be opened when required to enable de-scaling or replacement of the electrodes and cleaning of the container, and which may then be re-assembled for further use.

Boilers of the kind in which a lid carrying the electrodes is bolted to a flange on the container body, or the container body is made in two different parts held together by nuts and bolts or metal clamps, are not only expensive to manufacture, but it is often found that the nuts and bolts or clamps are corroded and difficult to remove when it is desired to open the boiler for servicing. This is particularly so when the container is made of a synthetic plastic material, which is more easily damaged by the application of heavy forces in freeing the parts.

The principal object of the invention is to provide an electrode boiler structure which is inexpensive to manufacture, is easily adpated for different applications and is very easy to service.

The invention consists of an electrode boiler for operation at substantially atmospheric pressure comprising a substantially cylindrical container made up of identical hollow upper and lower parts each closed at one end and open at the other end and moulded from a synthetic plastic material, the parts being placed with their open ends in juxtaposition, each part having a central connection at its closed end to form a steam outlet in the upper part and a water connection in the lower part, each part being formed with bosses which, in the upper part, are drilled through, a plurality of electrodes mounted in the drilled bosses, a circumferential enlargement forming a bead around the open end of each part, each bead being defined by a flat annular surface at the open end, a cylindrical portion extending from the flat surface, and a tapered portion extending from the cylindrical portion, indexing means on the annular flat surfaces to locate the two parts against relative rotation or transverse movement, and an endless elastic member around the two beads, the elastic member having two ring-shaped portions which closely embrace the two parts and an intermediate raised portion containing an internal groove with tapered sides corresponding with the tapered portions of the beads, the elastic member serving to draw the two parts together in their relatively located positions and to provide a liquid seal.

The provision of the flat annular surfaces on the two parts of the container and the resilient band enables a further advance to be made, in that the container may comprise upper and lower parts which are moulded from a synthetic plastic material and are identical, each part having a central tube at its closed end which forms the steam outlet of the upper part and the water connection of the lower part, each part being formed with bosses which, in the upper part, are drilled through to form mountings for the electrodes and are left undrilled in the lower half.

An example of a steam boiler or humidifier according to the invention will now be described with reference to the accompanying drawings in which FIG. 1 is a plan view of an electrode steam boiler or humidifier according to the invention;

Figure 1:
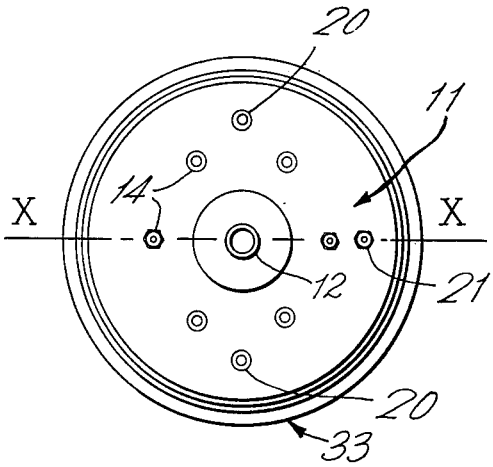
Figure 2:
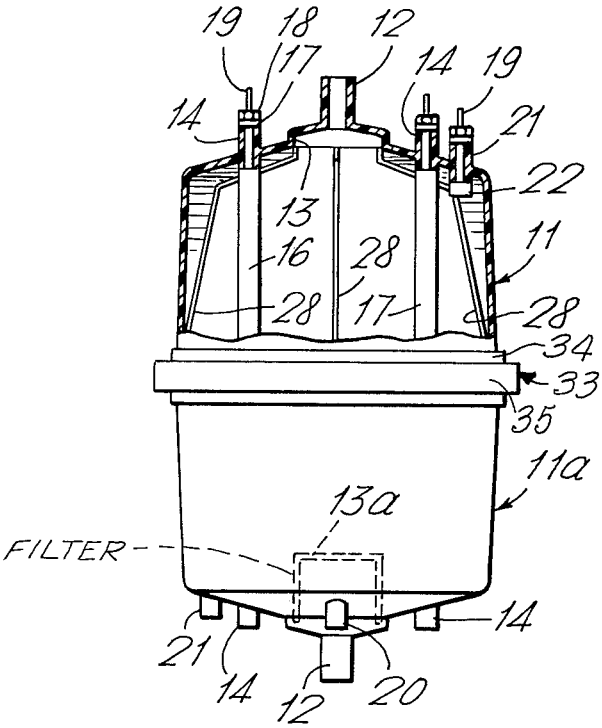
FIG. 2 is an elevation of the boiler of FIG. 1 with the upper part in section taken on the line X—X of FIG. 1.
Figure 6:
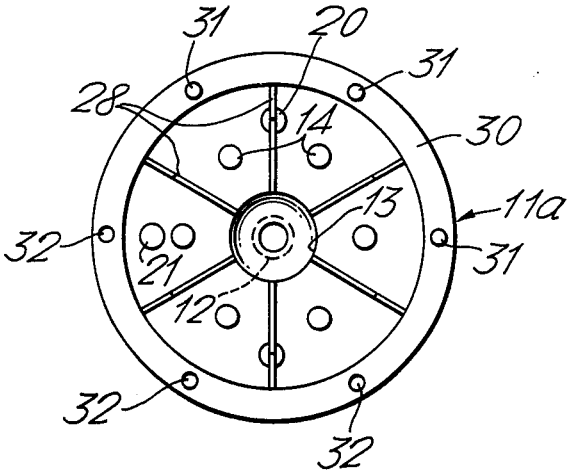
FIG. 6 is a view looking down into the lower part of the container.

Referring to the drawings, FIGS. 1, 2 and 6 show a plan, a part-sectional elevation and an internal view respectively of one form of boiler according to the invention. A typical size for such a boiler, which finds a large range of application, is an overall diameter of about 9½ inches (240 millimeters) and an overall height of 16 inches (400 millimeters) and this is designed to hold about 6 liters (about 1¼ gallons) of water with a "boiling space" at the top.

The boiler shown in the drawings comprises a container made up of two parts, respectively 11 and 11*a*, both parts being in the form of synthetic plastic mouldings. In the drawings the two parts are identical and are in the form of hollow mouldings each closed at one end and open at the other end, the container being formed by placing the open ends of the two mouldings together.

Figure 3:
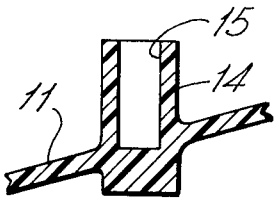
FIG. 3 is a section through one of the bosses formed in a container part drawn to a larger scale.

The closed end of each container part has a pipe 12 moulded on to it. The shape of the closed end is a very shallow stepped cone, and the stepped portion provides an internal diameter 13 to enable a filter (shown dotted at 13*a*) to be pushed into the moulding used as the bottom part 11*a*. Also formed on the closed end of each part is a ring of six equally spaced bosses 14. These bosses are moulded with blind bores 15, as shown in FIG. 3 and when a container half is used as the bottom part 11*a* these bosses are left as moulded, but when the container half is to form the upper part of the boiler the hole is drilled right through in at least some of the bosses. In the example shown two electrodes, respectively 16 and 17, have been fitted, each electrode being provided with a stem which passes through the hole in the respective boss 14, and a washer 17 and a nut 18 are used to secure the stem of the electrode, which has a screw-threaded end. Projecting beyond the screw-threaded end of each electrode is an integral pin 19 to which a connecting member, consisting of a spring socket (not shown) shrouded in insulating material, may be attached to enable very rapid electrical connection to be made.

In addition to the six bosses 14 there are two still further bosses 20 placed outside the ring of bosses 14. These bosses are also hollow for a part of their length but they are not drilled through in any event since they are used to locate and support the boiler in an enclosure such as a cabinet, which also houses automatic controls for the boiler. All the bosses are made hollow to provide economy in the use of materials.

A further boss 21 is of similar form to the bosses 14 and that on the top part is drilled through to accommodate an additional electrode 22 which is also secured by a nut and washer and is also provided with a connecting pin 19. This electrode is a "boiler full" electrode which is connected to the control apparatus, to provide a signal when the water in the boiler reaches the level of the "boiler full" electrode and makes contact with it. This electrode is provided for a particular system of control and, like the bosses 20, is optional, depending upon the type of control gear and the method of supporting the boiler which are adopted. The boss 21 on the bottom part is not drilled.

Figure 4:
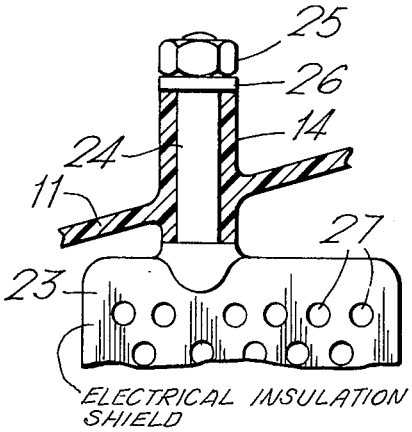
FIG. 4 is a section of a part of the container showing a boss with an inter-electrode shield fitted into it drawn to the same scale as FIG. 3.

By providing six bosses 14 it is possible to use two to accommodate a pair of electrodes to be connected to a single phase supply, as shown in the drawings, or to use three electrodes, forming the points of an equilateral triangle, to support three electrodes for a three phase supply. Where a single phase supply is employed the electrodes are spaced by the maximum amount which the size of the boiler allows. Where the corresponding three phase supply is to be used the inter-electrode voltage will be higher and the spacing of the electrodes is rather closer, and it may be desirable to reduce the magnitude of the current by drilling the spare bosses and fitting shields as shown in FIG. 4. In that Figure the boss 14 is drilled and the shield 23 consists of a flat plate of insulating material having a stem 24 which passes through the boss and is secured by a nut 25 with a washer 26 beneath it. The shield causes the current to travel a longer distance from one electrode to the adjacent electrode and thereby reduces the amount of current. However the shield 23 may be provided with apertures 27. Although these apertures partially defeat the object of fitting the shield by allowing some current to pass through them, they serve another extremely useful purpose in that, by allowing some of the current to pass through the shield, the shield is caused to collect a good deal of matter such as lime which would otherwise form scale on the electrodes. A moulded synthetic plastic shield is cheap to manufacture and is easy to replace. Moreover, the shield may be sufficiently flexible to enable the scale to be broken away from it so that the shield may be re-used. The apertures may be of any desired size and number and of any desired shape.

The inside of each container half is provided with thin strengthening ribs 28 of which three are shown in the upper part of FIG. 2, the ribs being placed so that in the circumferential direction they lie between the bosses 14.

The bosses 14 and 21 of the container part 11*a*, which is used as the bottom half of the boiler or humidifier, are left undrilled. The bosses 20 may be used for mounting and supporting the boiler and the open tube 12 is used for the water supply. A steam hose may be pushed on to the tube 12 of the container half 11 and a resilient fitting, which may be the end of a piece of hose or a specially made fitting containing an O-ring, may be pushed on to the tube 12 of the bottom part 11*a* of the container. It is quite usual in boilers of this kind to use the bottom connection as an inlet from which water is supplied to the boiler and also as a drain by which, from time to time, a quantity of water is allowed to drain off to carry away some of the contaminating material which is continually collecting in the boiler, the inlet and drain connection being controlled by electro-magnetically operated valves which are energized by the automatic control gear at intervals.

Figure 5:
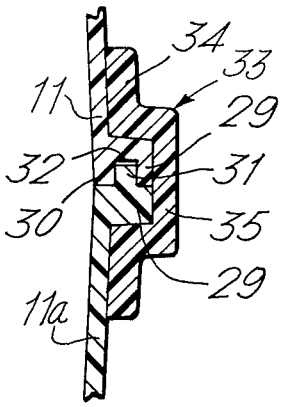
FIG. 5 is a section of a part of the centre of the boiler, also taken on the line X—X of FIG. 1, showing in detail the joint and a resilient band drawn to the same scale as FIGS. 3 and 4.

An important feature of the present invention is the means used to clamp the two container parts 11 and 11*a* together. As shown in FIG. 5, each container part is provided with a circumferential enlargement forming a bead 29 around its open end adjacent the flat annular surface 30. Each bead 29 is defined by the flat annular surface 30 at the open end of the container part, a cylindrical portion extending from the flat annular portion and a sharply tapered portion extending from the cylindrical portion. Indexing means are provided to locate the two parts of the container against rotation or transverse movement with respect to each other and conveniently consist of dowel pins 31 engaging in holes 32. If a plurality of dowel pins is moulded around one half of the surface 30 and an equal number of equally spaced and equally sized dowel holes is moulded into the other half of the surface 30 then, by rotating one container part through 180° with respect to the other, the two parts will locate together. In another arrangement holes and pins may alternate around the circular surface and, provided that the total number of pins and holes is an even number and the pins and holes are equally spaced and equally sized, the two parts may be located in a number of different positions with respect to each other. In FIG. 1 the lower container part 11*a* is rotated through 180° with respect to the upper container part 11.

In the arrangement of FIG. 5 the two parts of the container are held together in a very simple manner by providing a band, generally indicated by reference 33. The band consists of two ring-shaped portions 34 with an intermediate raised portion 35 containing an internal groove with tapered sides corresponding with the tapered portions of the beads. The band is moulded in a suitable resilient material such as rubber or a synthetic plastic material and, having placed the two halves of the container together and correctly located them, it is only necessary to stretch the band 33, place it over the joint and allow it to relax, when the two ring-shaped portions 34 will grip the respective container halves and the raised portion 35 will stretch over the two beads and pull them towards each other. This method of holding the two container parts together is extremely simple and surprisingly effective. The shape of the band need not be as shown in the drawings; in fact, in early experiments, plain bands cut from the inner tube of a motor vehicle tire were used.

It should be remembered that the boiler operates virtually at atmospheric pressure and the pressure will only rise by a very small amount above atmospheric pressure due to the resistance of the steam pipe to the passage of the steam and possibly a slight pressure in an air conditioning trunk into which the steam is being fed. Consequently the resilient band provides a fully adequate liquid seal between the two parts of the container. It will be evident from the foregoing description that the invention provides a simple, highly efficient and very inexpensive method of holding the two parts of the container together, and that the assembly and disassembly of the container is rapid and very easy.

I claim:

1. An electrode boiler for operation at substantially atmospheric pressure comprising a substantially cylindrical container made up of identical hollow upper and lower parts each closed at one end and open at the other end and moulded from a synthetic plastic material, the parts being placed with their open ends in juxtaposition, each part having a central connection at its closed end to form a steam outlet in the upper part and a water connection in the lower part, each part being formed with bosses which, in the upper part, are drilled through, a plurality of electrodes mounted in the drilled bosses, a circumferential enlargement forming a bead around the open end of each part, each bead being defined by a flat annular surface at the open end, a cylindrical portion extending from the flat surface, and a tapered portion extending from the cylindrical portion, indexing means on the annular flat surfaces to locate the two parts against relative rotation or transverse movement, and an endless elastic member around the two beads, the elastic member having two ring-shaped portions which closely embrace the two parts and an intermediate raised portion containing an internal groove with tapered sides corresponding with the tapered portions of the beads, the elastic member serving to draw the two parts together in their relatively located positions and to provide a liquid seal.

2. A boiler as claimed in claim 1 in which each part is formed with additional bosses which, in the upper part, are drilled, and inter-electrode shields are mounted in the drilled additional bosses.

3. A boiler as claimed in claim 2 in which the inter-electrode shields are made of a synthetic plastic material.

4. A boiler as claimed in claim 3 in which the inter-electrode shields are perforated.

5. A boiler as claimed in claim 1 in which each part is formed with a further boss which, in the upper part, is drilled, and a boiler water level sensing electrode is mounted in the drilled further boss.

6. A boiler as claimed in claim 1 in which each part is formed with still further bosses which are not drilled and are used as supports by which the boiler may be mounted.

7. A boiler as claimed in claim 1 in which each part of the container is formed with a shallow stepped cone at its closed end, the stepped portion providing an internal diameter into which the water connection opens, and a filter being pushed into the internal diameter in the bottom part.

* * * * *